US006669388B1

(12) United States Patent
Short

(10) Patent No.: US 6,669,388 B1
(45) Date of Patent: Dec. 30, 2003

(54) FINGER-MOUNTED MARKING DEVICE

(76) Inventor: Ronald J. Short, 1196 Foxford Dr., Avon, IN (US) 46123

( * ) Notice: Subject to any disclaimer, the term of this patent is extended or adjusted under 35 U.S.C. 154(b) by 0 days.

(21) Appl. No.: 10/304,942

(22) Filed: Nov. 26, 2002

(51) Int. Cl.[7] ..... A46B 5/02
(52) U.S. Cl. ..... 401/8; 401/7
(58) Field of Search ..... 401/6–8; 15/437, 15/438, 443, 444

(56) References Cited

U.S. PATENT DOCUMENTS

| | | | | | |
|---|---|---|---|---|---|
| 36,652 | A | * | 10/1862 | Jacobs | 401/8 |
| 974,887 | A | | 11/1910 | Huddle | |
| 1,206,976 | A | | 12/1916 | Barth | |
| 1,681,842 | A | * | 8/1928 | Collen | 401/8 |
| 3,005,441 | A | * | 10/1961 | Glasscock | 401/8 |
| 3,402,984 | A | | 9/1968 | Zazzara | |
| 3,596,964 | A | | 8/1971 | Zazzara | |
| 3,662,629 | A | * | 5/1972 | Lance | 81/468 |
| 4,127,338 | A | | 11/1978 | Laybourne | |
| 4,332,178 | A | * | 6/1982 | Vukich | 401/8 |
| 4,447,912 | A | | 5/1984 | Morrow | |
| 4,738,556 | A | | 4/1988 | Brown | |
| 4,917,517 | A | * | 4/1990 | Ertz | 401/6 |
| 5,391,010 | A | | 2/1995 | Gorbunov | |
| 5,405,206 | A | * | 4/1995 | Bedol | 401/7 |
| 5,529,415 | A | | 6/1996 | Bishop | |
| 5,542,588 | A | | 8/1996 | Sison | |
| 5,722,575 | A | | 3/1998 | Smith | |
| 5,868,509 | A | * | 2/1999 | Crutcher | 401/8 |
| 5,885,018 | A | | 3/1999 | Sato | |
| 5,944,433 | A | | 8/1999 | O'Mara et al. | |
| 5,971,642 | A | | 10/1999 | O'Mara et al. | |
| D418,494 | S | | 1/2000 | Robb | |
| D458,933 | S | | 6/2002 | Schneider | |
| 2001/0007392 | A1 | | 7/2001 | Sugarman | |

* cited by examiner

*Primary Examiner*—Tuan N. Nguyen
(74) *Attorney, Agent, or Firm*—Woodard, Emhardt, Moriarty, McNett & Henry LLP

(57) ABSTRACT

A finger-mounted marking device allowing marking instruments such as a pen or pencil to be worn on a finger, and allowing for hands-free usage without engaging other fingers. Two rings are coupled to the cylinder for receiving the operator's finger. A cylinder holds a marking instrument, and a set screw holds the marking instrument in place. The marking instrument can be adjusted or replaced based on the desires of the operator.

12 Claims, 2 Drawing Sheets

FINGER-MOUNTED MARKING DEVICE

TECHNICAL FIELD OF THE INVENTION

The present invention relates to marking instruments and, in particular, to a marking instrument adjustably mounted in a holder with a set screw, and operative to allow hands-free usage.

BACKGROUND OF THE INVENTION

Various types of finger-mounted marking devices are in use today. Some of them are worn on an index, thumb, or other finger. These require the use of other fingers to hold the device while writing. Other marking devices are worn on a finger tip. In such cases, the marking device gets in the way when it is not in use. Many of the current finger-mounted marking devices require special sizes or designs of pens or pencils that are not widely available. Others have writing instruments permanently mounted that cannot be adjusted or replaced.

There is thus a need for a finger-mounted marking device that allows for handsfree use without other fingers, yet that will remain out of the way when not in use. Furthermore, a need exists for a device allowing adjustment of the marking instrument to different positions and for easy replacement with marking instruments that are commonly available.

SUMMARY OF THE INVENTION

One object of the present invention is to provide a finger-mounted marking device that allows hands-free use without gripping the device with other fingers.

Another object is to provide a finger-mounted marking device that allows a pen or pencil position with respect to the device to be adjusted and held in place.

The invention comprises a finger-mounted device for a marking instrument such as a pen or pencil to be worn on a finger, such as an index finger. The device comprises a cylinder with two rings coupled to the cylinder. The two rings are designed to accept a finger. The cylinder contains an opening for accepting a set screw and the set screw, when inserted and tightened, secures the marking instrument in place.

In one embodiment of the present invention, a finger-mounted marking device is disclosed comprising: a plurality of rings; a cylinder coupled to the plurality of rings; the plurality of rings being operative to receive a finger; the cylinder being operative to receive a marking instrument; a grooved hole in the cylinder; a set screw for securing the marking instrument in the cylinder through the grooved hole.

In another embodiment of the present invention, a hands-free method of using a finger-mounted marking device is disclosed, the method comprising: having a marking device on top of a finger; and using the marking device to mark without engaging other fingers.

DETAILED DESCRIPTION OF THE PREFERRED EMBODIMENTS

Figure 1:
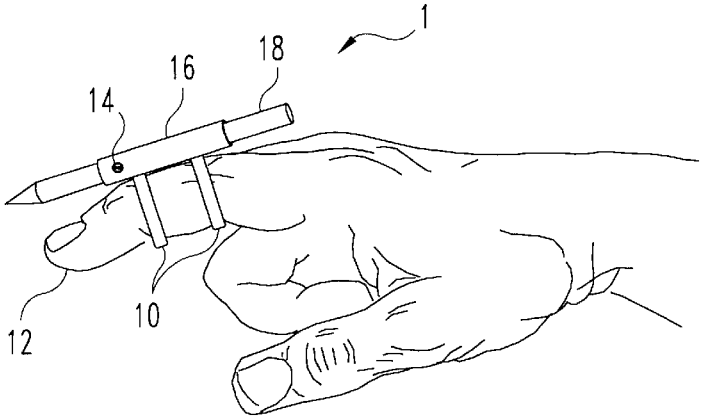
FIG. 1 is a side elevational view of a finger-mounted marking device of a preferred embodiment in use with a marking instrument and portions of an operator's finger.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

The present invention provides a method and apparatus for a finger-mounted marking device allowing for hands-free use and adjustable/replaceable marking instruments.

Figure 4:
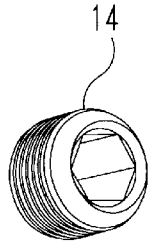
FIG. 4 shows an example of a preferred embodiment set screw that can be inserted into the cylinder to secure the marking instrument.
Figure 5:
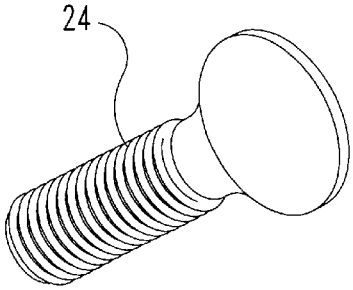
FIG. 5 shows an example of a thumb screw that can be inserted into the cylinder to secure the marking instrument.
Figure 6:
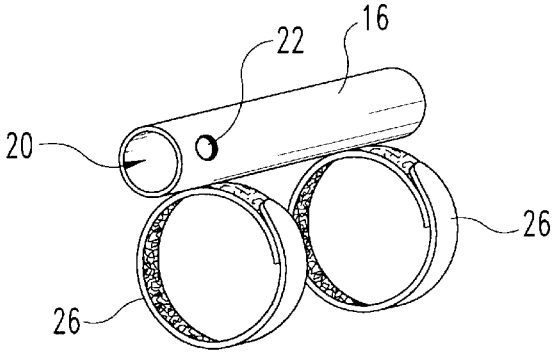
FIG. 6 is a perspective view of a marking device showing adjustable rings.

Referring to FIGS. 1–6, a finger-mounted marking device 1 is shown. Two rings 10 are coupled to a cylinder 16. The rings and cylinder can be made of a variety of materials, such as metal or plastic, as a few examples. The cylinder can be one of a variety of sizes for fitting various types of marking instruments. As shown in FIG. 6, the rings can optionally be adjustable in size to fit varying finger sizes, such as being made of nylon straps with velcro 26, as one non-limiting example. In an alternate embodiment, there may be just a single ring with a wider band, such as a single ring spanning the distance between the two rings 10 on FIG. 1.

In a preferred embodiment, the rings 10 receive a finger 12 of the operator. The finger 12 is preferably, but not necessarily, an index finger. A marking instrument 18 is inserted into the cylinder 16 and secured with a set screw 14. The marking instrument can be a pen, a pencil, or a piece of chalk, to name a few examples.

The rings 10 along with the set screw 14 of the cylinder 16 securely hold the marking instrument 18 in place against the operator's finger so that he can use the device without gripping the device with other fingers. This hands-free use of the marking device without having to engage other fingers enables the operator to continue using the other fingers for a different purpose while writing with the marking device. For example, an operator who is holding a tape measure can make a mark without letting go of the tape measure.

Figure 2:
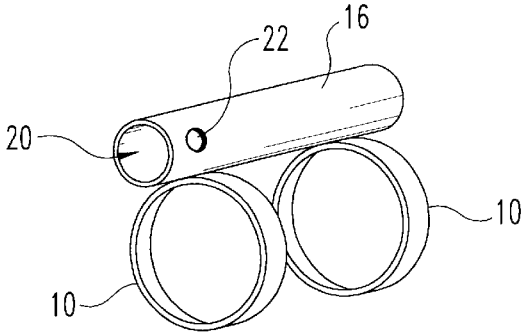
FIG. 2 is a perspective view of a marking device of a preferred embodiment without the marking instrument.
Figure 3:
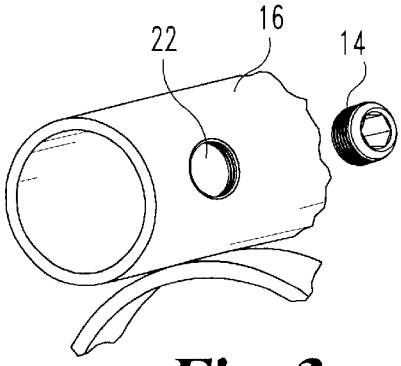
FIG. 3 is a partial perspective view showing the grooves of a preferred embodiment of the cylinder where the set screw is inserted.

As shown in FIGS. 2 and 3, the cylinder 16 preferably contains grooves 22 for accepting a set screw to secure a marking instrument 18 that was inserted into the inner cavity 20 of the cylinder 16.

A set screw, such as one shown in FIG. 4, when inserted into the grooves 22 of the cylinder 16 will securely hold a marking instrument in place. This set screw can be made of many different materials, such as metal or plastic. Furthermore, in a preferred embodiment, the set screw is of the type that is adjusted with a hex key. As shown in FIG. 5, in another embodiment, the set screw can be a thumb screw 24 that is adjusted by the operator's fingers. Other types of set screws as familiar to those skilled in the art can also be used.

Returning to FIG. 1, the set screw 14 allows a marking instrument 18 to be adjusted to varying positions based on the desires of the operator. Furthermore, the set screw allows for easy removal of the marking instrument so that it can be replaced as desired. Marking instruments of varying types and lengths can be used and thus replacements are commonly available.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A finger-mounted marking device comprising:

a plurality of non-metallic rings;

a cylinder coupled to the plurality of rings;

wherein the plurality of rings are operative to receive a single finger and are to be worn at a part of said single finger to allow the marking device to remain thereon and out of the way when not in use so as not to impede the action of said single finger;

wherein the cylinder is operative to receive a marking instrument;

a hole in the cylinder;

a set screw for securing the marking instrument in the cylinder through the hole; and wherein the marking device is operative to mark without engaging the marking device with any fingers other than said single finger.

2. The device of claim 1, wherein the single finger is an index finger.

3. The device of claim 1, wherein the set screw is adjustable with a hex key.

4. The device of claim 1, wherein the set screw is a thumb screw.

5. The device of claim 1, wherein the marking instrument is a pen.

6. The device of claim 1, wherein the marking instrument is a pencil.

7. The device of claim 1, wherein the marking instrument is chalk.

8. The device of claim 1, wherein the cylinder is made out of metal.

9. The device of claim 1, wherein the cylinder is made out of plastic.

10. The device of claim 1, wherein the plurality of rings are each made out of nylon with a fastener.

11. The device of claim 1, wherein the plurality of rings are made out of plastic.

12. The device of claim 1, wherein the plurality of rings are adjustable in size.

* * * * *